US010718201B2

(12) United States Patent
Lubrecht et al.

(10) Patent No.: US 10,718,201 B2
(45) **Date of Patent: *Jul. 21, 2020**

(54) SYSTEM AND METHOD FOR INSTALLING CASING IN A BLIND HORIZONTAL WELL

(71) Applicant: Directed Technologies Drilling, Inc., Bremerton, WA (US)

(72) Inventors: Michael D. Lubrecht, Monroe, WA (US); James M. Doesburg, Steilacoom, WA (US); Daniel W. Ombalski, Julian, PA (US); James Ditto, Mineral Wells, TX (US)

(73) Assignee: ELLINGSON DRAINAGE, INC., West Concord, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/919,685

(22) Filed: Mar. 13, 2018

(65) Prior Publication Data

US 2018/0209261 A1 Jul. 26, 2018

Related U.S. Application Data

(60) Continuation-in-part of application No. 14/935,280, filed on Nov. 6, 2015, now Pat. No. 10,036,240, and a continuation-in-part of application No. 14/887,137, filed on Oct. 19, 2015, now Pat. No. 10,465,486, application No. 15/919,685, which is a continuation of application No. 14/517,903, filed on Oct. 19, 2014, (Continued)

(51) Int. Cl.

| | |
|---|---|
| ***E21B 10/62*** | (2006.01) |
| ***E21B 47/01*** | (2012.01) |
| ***E21B 10/64*** | (2006.01) |
| ***E21B 7/20*** | (2006.01) |
| ***E21B 47/12*** | (2012.01) |

(52) U.S. Cl.

CPC ..... *E21B 47/01* (2013.01); *E21B 7/20* (2013.01); *E21B 10/62* (2013.01); *E21B 10/64* (2013.01); *E21B 47/122* (2013.01); *E21B 47/124* (2013.01)

(58) Field of Classification Search

CPC ..... E21B 47/01; E21B 47/124; E21B 47/122; E21B 7/20; E21B 10/62; E21B 10/64

See application file for complete search history.

(56) References Cited

U.S. PATENT DOCUMENTS

| | | | | |
|---|---|---|---|---|
| 9,376,869 | B1 * | 6/2016 | Lubrecht | E21B 7/20 |
| 9,915,141 | B1 * | 3/2018 | Lubrecht | E21B 7/20 |
| 2010/0256913 | A1 * | 10/2010 | Kuckes | E21B 47/02224 702/6 |

* cited by examiner

*Primary Examiner* — Brad Harcourt

(74) *Attorney, Agent, or Firm* — Paul B. Heynssens Attorney at Law, PLC

(57) ABSTRACT

A system and method for installing casing in a blind horizontal well for blind horizontal directional borings. The system and method may include an example of an offset transmitter sonde assembly that contains an open central passage through which well casing can be inserted, and an example of a drill bit assembly that may be remotely uncoupled from a drill string, leaving the bit in the bore created. Remote uncoupling of the drill bit assembly tends to allow a casing to be installed in the bore while the drill string and bit remain in the bore for support during casing installation. After installation of the casing the drill bit assembly may be uncoupled from the drill string, allowing the drill string to be withdrawn from the bore, with the drill bit assembly remaining in the bore.

19 Claims, 14 Drawing Sheets

Related U.S. Application Data now Pat. No. 9,915,141, which is a division of application No. 13/543,554, filed on Jul. 6, 2012, now Pat. No. 9,376,869.

(60) Provisional application No. 62/076,259, filed on Nov. 6, 2014, provisional application No. 62/065,746, filed on Oct. 19, 2014, provisional application No. 61/523,253, filed on Aug. 12, 2011.

Double Ended
Installation
100

Double Ended Installation Process 200

Locking
Gun
Mount
101

Single Ended Knock-Off Installation 500

Single Ended Knock-Off Installation
600

Offset Sonde Housing 800

Offset Sonde
Housing-End View
800

Process for Disengaging or Knocking Off a Drill Bit
1100

Knockoff Bit Assembly Drilling Configuration 1200

Knockoff Bit Assembly
Drill Bit Knocked Off
1400

SYSTEM AND METHOD FOR INSTALLING CASING IN A BLIND HORIZONTAL WELL

CROSS-REFERENCE TO RELATED APPLICATION(S)

This application is a continuation of pending U.S. patent application Ser. No. 14/517,903 filed Oct. 19, 2014, issued as U.S. Pat. No. 9,915,141 on Mar. 13, 2018, which is a divisional of U.S. application Ser. No. 13/543,554 filed Jul. 2, 2012, now U.S. Pat. No. 9,376,869 issued Jun. 28, 2016, which in turn claims priority to US provisional application 61/523,253 filed Aug. 12, 2011 the disclosure of which is incorporated in its entirety. This application is also related to U.S. patent application Ser. No. 14/517,905 filed Oct. 9, 2014 now abandoned. This application is also a continuation-in-part of application Ser. No. 14,887,137 filed Oct. 19, 2015 which is based on US provisional application No. 62/065,746 filed Oct. 19, 2014 the disclosure of which is incorporated in its entirety. This application is also a continuation-in-part of U.S. patent application Ser. No. 14/953,280 filed Nov. 6, 2015 which in turn claims priority to US provisional patent application No. 62/076,259 filed Nov. 6, 2014 the disclosure of which is incorporated in its entirety.

TECHNICAL FIELD

The present invention relates generally to installing casing in blind horizontal wells and more specifically it relates to a method for installing well screen and casing in blind horizontal directional borings.

BACKGROUND

Directional boring, commonly called horizontal directional drilling of a horizontal well is a steerable trenchless method of installing underground pipes, conduits and cables or the like in a shallow arc, under ground typically along a prescribed bore path by using a surface launched drilling rig. Pipes laid, or well casing installed in this manner can be made of materials such as iron, steel, PVC, polyethylene, polypropylene, or the like. With this type of drilling there is typically minimal impact on the surrounding area over using a trencher. Directional boring can often be used when trenching or excavating is not practical, such as under roadways, or other existing structures, or at greater depths than it is possible to trench. It is suitable for a variety of soil conditions and jobs that may include road, landscape and well monitoring applications.

However, in soft or loose soils drilling a well can be problematic, since standard practice can be to drill a bore hole, retract the drill, and then insert the casing or the like, while hoping that the unsupported bore hole does not collapse or otherwise become obstructed before the casing or cable is installed. Accordingly a way of keeping the bore hole unobstructed during installation of, well casing or the like would be useful in well drilling in such soil conditions.

SUMMARY

The following presents a simplified summary of the disclosure in order to provide a basic understanding to the reader. This summary is not an extensive overview of the disclosure and it does not identify key/critical elements of the invention or delineate the scope of the invention. Its sole purpose is to present some concepts disclosed herein in a simplified form as a prelude to the more detailed description that is presented later.

This presents a system and method for installing well screen and casing in blind horizontal directional borings. The system provides a system and method that includes using a hollow drilling string, constructed such that when a well casing, or tool such as an unlatching collar is inserted into the drilling string that has bored a hole, a drill bit may be disengaged from the drilling string by action of the well casing inserted, so that the remaining drilling string components may be removed from the bore hole, leaving the well casing in the bore hole. The disengaged, or knocked off drill bit remains in the bore hole.

The system and method may include an example of an offset sonde transmitter assembly to guide the drill. The offset sonde transmitter contains an open central passage through which well casing can be inserted. Upon completion of drilling the offset sonde transmitter assembly may be recovered from the bore hole.

The system may also include an example of a drill bit assembly including a separable adapter structure that may be remotely uncoupled ("knocked off") from a drill string, by disengaging a latch structure by insertion of the well casing, or unlatching collar, leaving the bit in the bore created. The drilling string that has been supporting the bore hole walls may then be removed Prior to installation of the casing in a completed bore, the drill bit assembly may be remotely uncoupled from the drill string, allowing casing to be installed in the bore while the drill rod and other components of the down-hole assembly remain in the bore to support the bore walls during casing installation. After installation of the casing the drill rod may be withdrawn from the bore, with the drill bit assembly remaining in the bore.

Alternatively, an unlatching collar may be inserted into the bore hole coupled to a smaller diameter drill rod to disengage the drill bit, removed from the bore, and the well casing may then be installed after the unlatching collar and smaller diameter drill rod has been removed.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

The examples below describe a System and Method for Installing Casing in a Blind Horizontal Well. Although the present examples are described and illustrated herein as being implemented in a horizontal system, the system described is provided as an example and not a limitation. As those skilled in the art will appreciate, the present examples are suitable for application in a variety of different types of drilling or boring systems.

Figure 1:
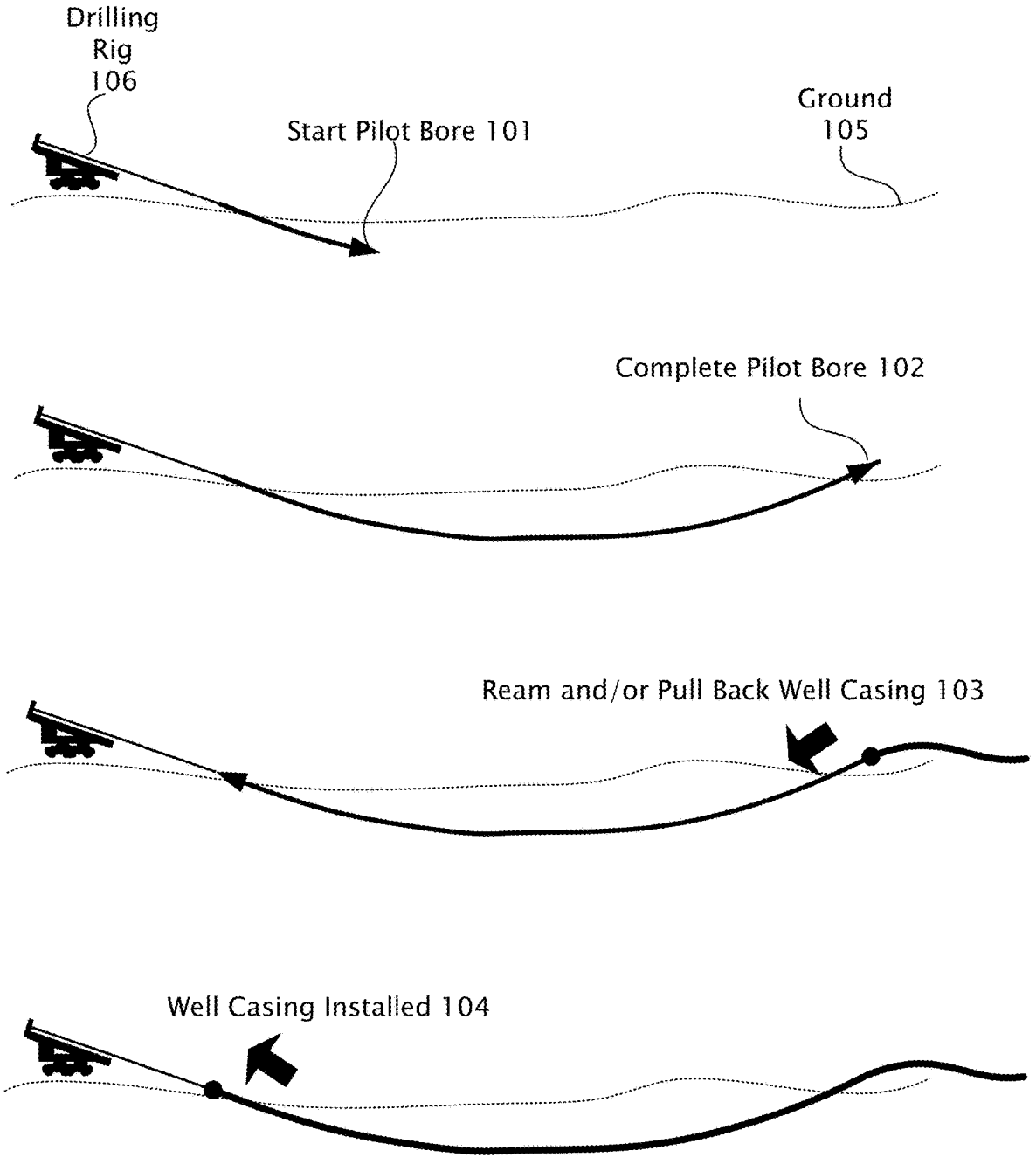
FIG. 1 shows a horizontal drilling operation.

FIG. 1 shows a horizontal drilling operation, or double ended installation, or equivalently double ended completion 100. The double ended completion drilling is shown at various stages of completion. Horizontal directional drilling may be used to install utilities and pipelines and to construct river crossings and shoreline approaches for submerged pipelines, power and communications lines and the like. Horizontal drilling may also be used to install horizontal wells for environmental projects such as the remediation of contaminated soil and groundwater, for reinjection of treated water from industrial processes, for groundwater development and the like.

In a type of horizontal directional drilling project called double-ended completion a well casing may be installed, a drill rig 106 may be situated at an entry location 101. A borehole is extended under ground 105 to an exit location 102 some distance away, whereupon the drill bit (not shown) at the end of a drilling string may be detached and a swivel and reaming tool (not shown) may be attached. The product (not shown) to be installed on the bore hole (such as exemplary casing, wiring, or the like) is then attached to the swivel and the material is pulled back 103 into the exit end of the boring until it emerges at the entry end, and the exemplary well casing is installed 104.

Figure 2:
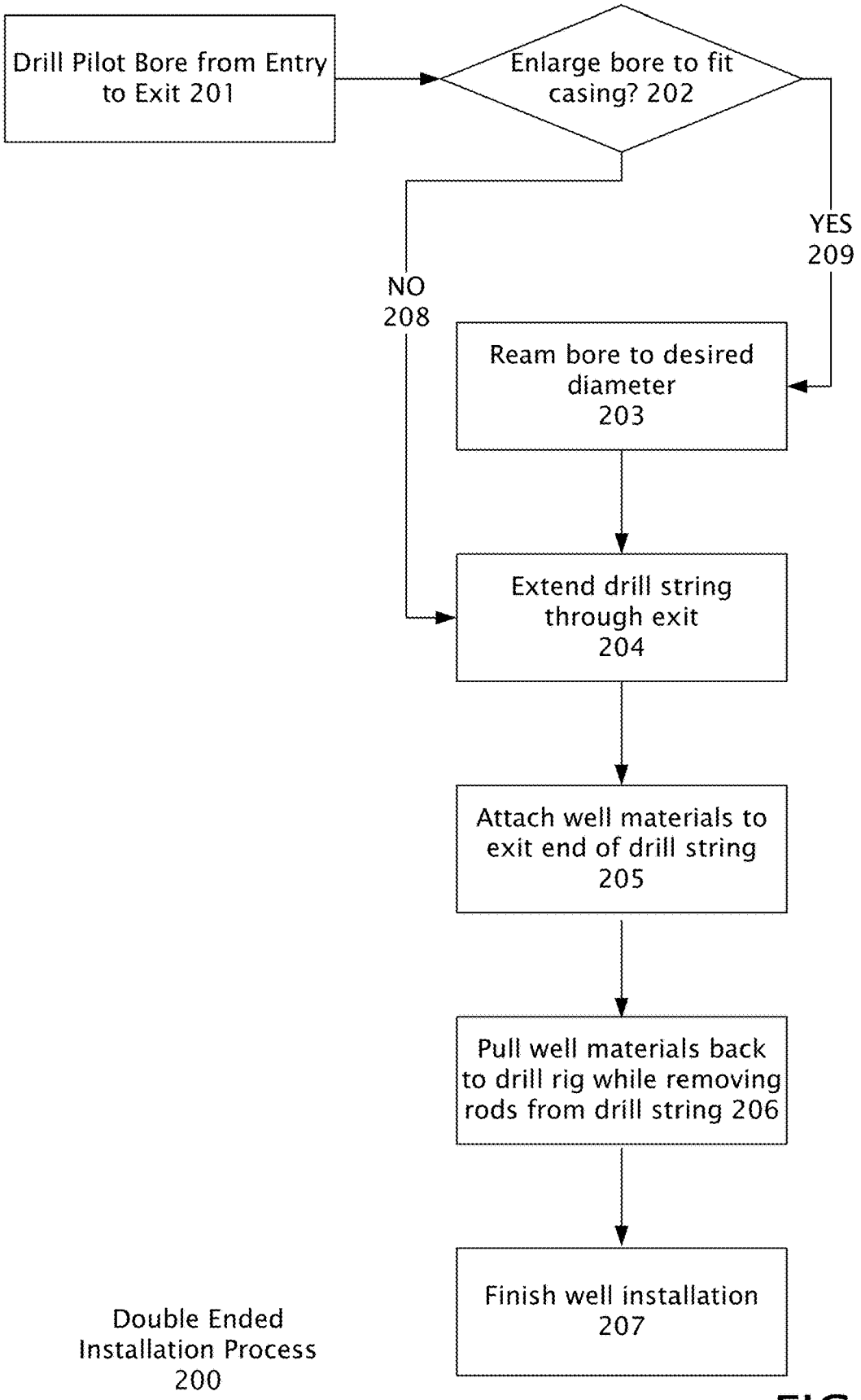
FIG. 2 shows a process for horizontal drilling.

FIG. 2 shows a process for horizontal drilling, or double ended installation. First a pilot bore may be drilled from entry to an exit point 201. Next a decision is made at 202 where it is determined if the bore needs to be enlarged so the casing may fit. If the casing will not fit, and the bore needs to be enlarged 209 than at block 203 the bore is reamed to the proper diameter before proceeding to block 204. If the bore does not need to be enlarged 208, the drill string is next extended through the bore to the exit 204. Continuing on at block 205, materials to be disposed in the well bore are attached to the end of the drilling string. Next the drilling string and attached materials are pulled back towards the drilling rig, while the rods are removed from the drilling string 206. And finally at 207 the well instillation is complete.

Figure 3:
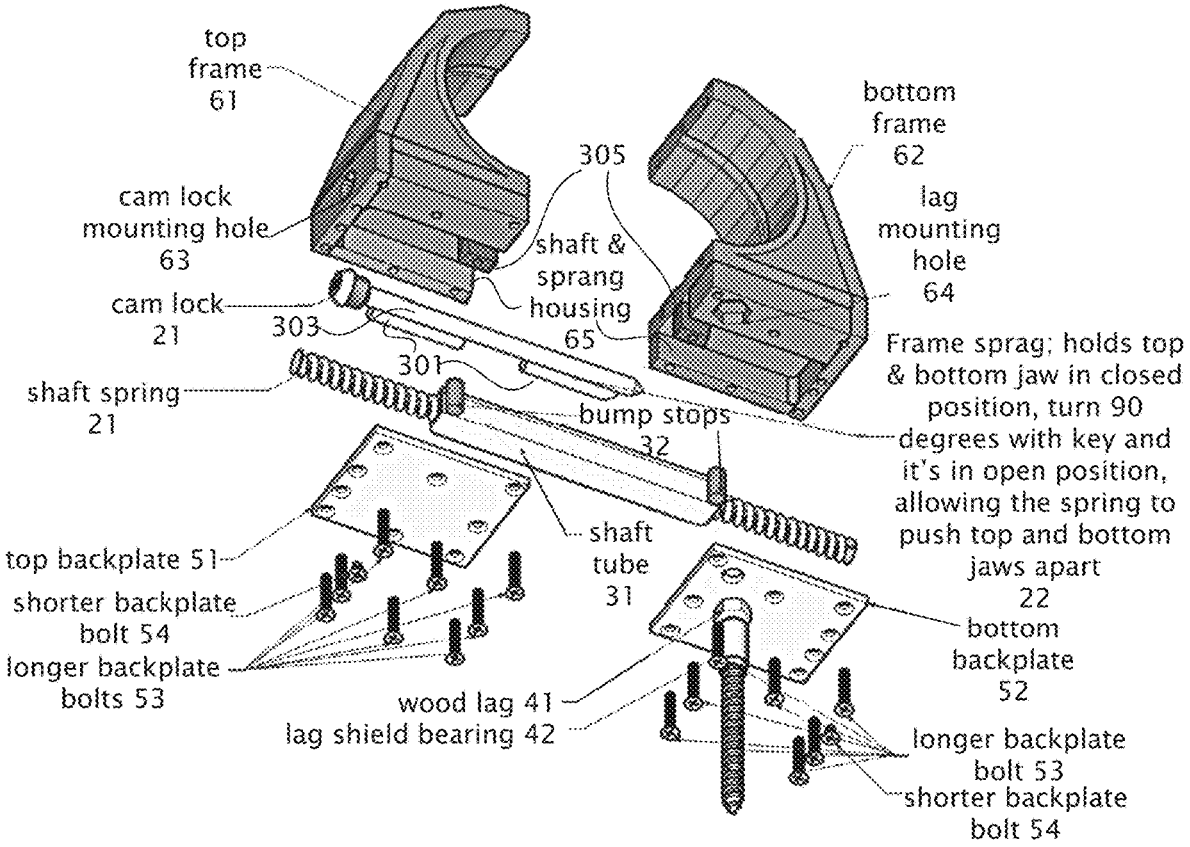
FIG. 3 shows a system for drilling and installing a well casing in a single ended completion.

FIG. 3 shows a system for drilling and installing a well casing in a single ended completion 300. The single ended completion drilling is shown at various stages of completion. In a type of horizontal directional drilling project called single-ended completion, or "blind" well completion the borehole may not exit the ground 105. Instead, the drilling rig 106, may start the pilot bore 301, with the bore drilled to some length without having exited the ground 105. After the pilot bore is complete. the bore hole may be reamed if needed 302. Next, the drilling tools that may include a drilling string or a reamer are removed from the borehole 303, and the well casing and screen are installed from the entry end 304. Such an installation procedure is similar to that for a conventional vertical well. This type of drilling may often be used for environmental projects.

Figure 4:
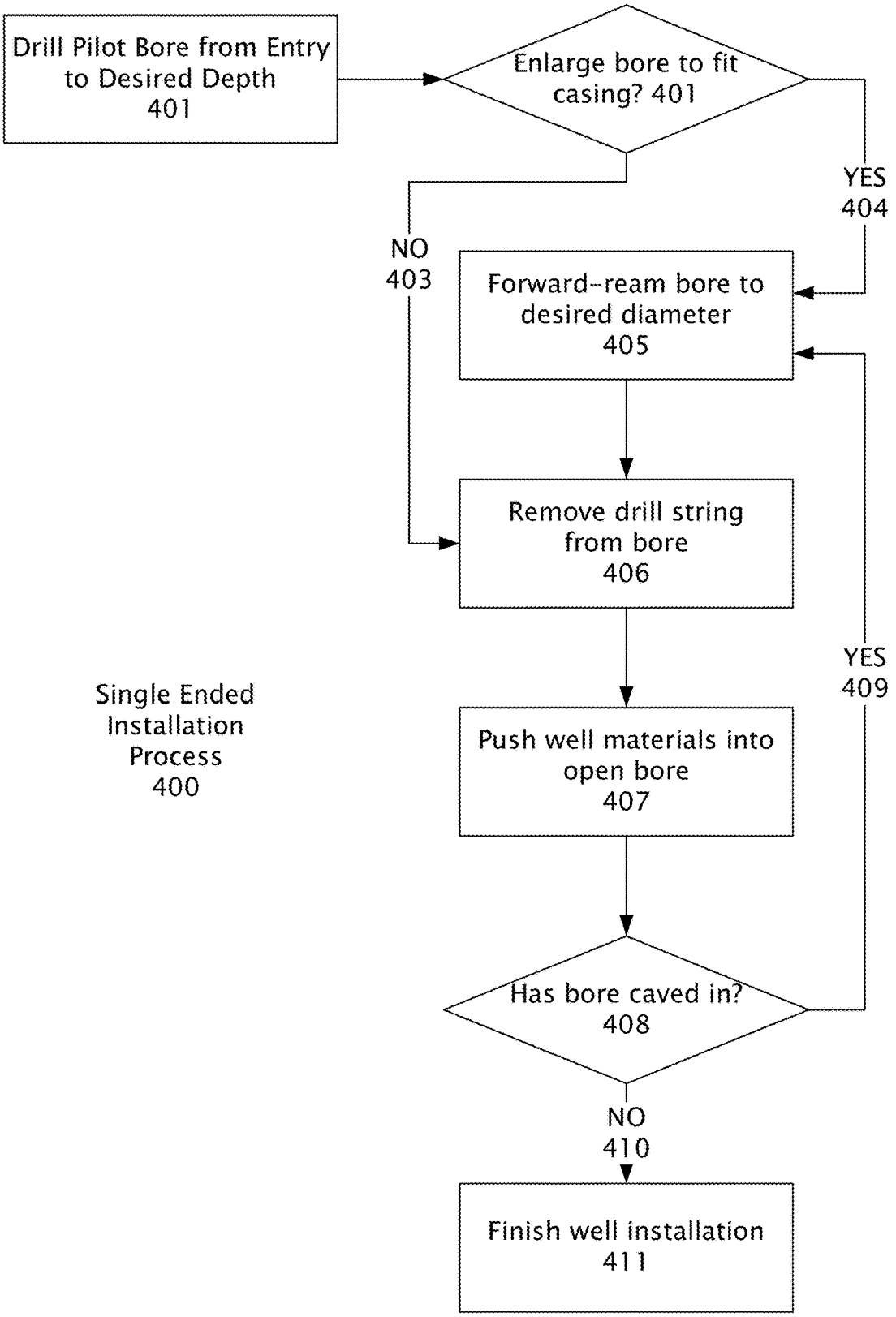
FIG. 4 shows a process for single ended completion drilling.

FIG. 4 shows a process for single ended completion drilling 400. First a pilot hole or bore may be drilled from an entry point to a desired depth 401. Next, after the bore reaches it desired depth it is determined if the bore needs to be enlarged to fit a casing being installed in the well 401. If the bore needs enlarging 404 the bore is forward reamed to a desired diameter 405. The sub process in block 406 is then executed.

Returning to block 401, if the bore does not 403 need to be enlarged to fit the casing, then the drilling string is removed from the bore 406. Well materials to be installed into the bore hole, are pushed in from the entry location. Occasionally during this process the bore hole might have caved in 408. If so 409, then the process returns to block 405, where it is repeated to open the closed bore. If not 410 then the well instillation is finished 411.

There can be problems in single-ended completion drilling. In cohesive soil materials, single-ended completion generally provides acceptable results. The borehole may remain open for a sufficient duration to allow the well materials to be inserted. However, in non-cohesive soil materials, the borehole may collapse, preventing the installation of the well materials. This may call for re-drilling the bore to a larger size, using higher viscosity drilling fluid, or other remedies that may degrade the effectiveness of the completed well.

Also in horizontal directional drilling the bore is not necessarily straight. During the drilling operation, the drilling tools can be steered by orientation of an asymmetric drill bit, guided by information received from a transmitter sonde (not shown) that is disposed in the drill string. A conventionally constructed sonde is typically positioned in-line behind the drill bit. In exemplary implementations, the sonde transmitter may be encased in a sonde housing made of steel or other suitable material, with ports machined into the housing walls to allow the transmitter signal to escape. The conventionally constructed sonde in current implementations is substantially centered along the central axis of the sonde housing.

Figure 5:
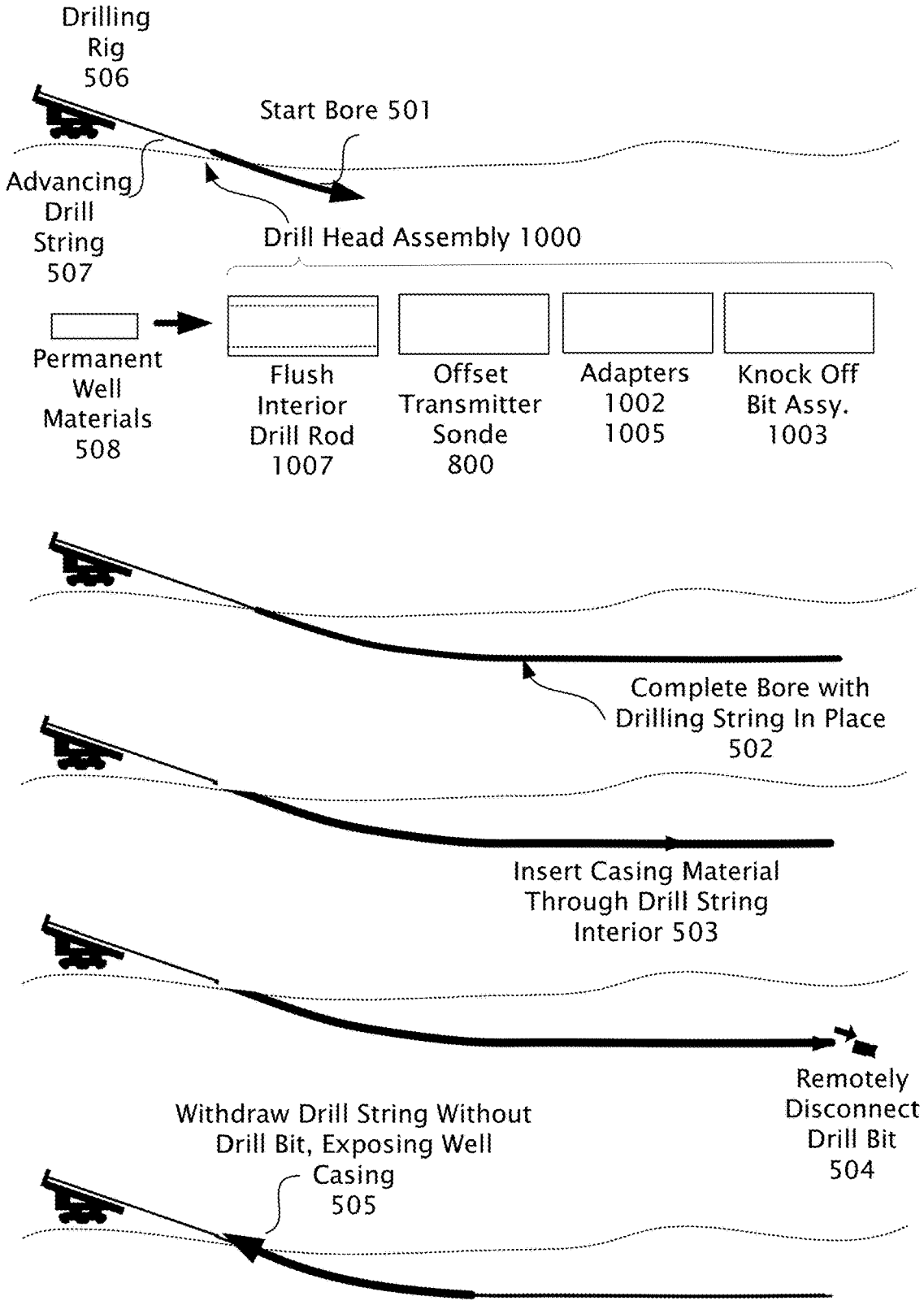
FIG. 5 shows a specially designed system for drilling and installing well casing in a single-ended completion that tends to improve drilling performance.

FIG. 5 shows a new system for drilling and installing well casing in a single-ended completion that tends to improve drilling performance by utilizing a knock off drill bit 500. This type of drilling makes use of a specially constructed drill bit assembly, that includes a drilling string with a knock off drill bit and a specially constructed sonde housing, to implement a new method of horizontal drilling.

The system and method also uses drill rods with a open interior passage that enables the well casing and screen to be emplaced through the drill string. The system and method also uses a unique navigation sonde housing, described herein, that uses an offset sonde cavity to maintain a through passage within the sonde housing. The system and method also uses a special drill bit holder or latching mechanism, also described herein, that transmits torque and thrust to the bit in a conventional manner, but permits the drill bit to be detached underground after the drilling has been completed, allowing the drill string to be retracted over the emplaced well materials after they have been pushed into the drill rods.

To illustrate the specialized system and method in operation a well during various stages of completion is shown 500. As shown a drilling rig 506 with controls suitable for operation as part of the modified drilling system starts a bore 501 utilizing a knock off drill bit (shown generally at 504) coupled to the large diameter drilling string and the unique sonde housing (not shown). This is unlike the usual pilot bore where the drilling string is removed prior to installing the well casing. Here the string remains in the bore until the well casing is in place. As the bore progressed from start 501, to completion 502, the drilling rig 506 controls the drilling progress, and guides the drill as the bore is completed 502.

When the bore is completed 502, the large bore drill string remains in the pilot bore, with the hollow drill rod supporting the walls of the bore hole (unlike the conventional process where the drilling string is retracted and the walls of the bore hole may be prone to collapse). In the typical process the drilling string must be removed before casing is inserted into the bore hole because the drill bit is fixed at the end of the string and the string and drill bit must be removed to make way for the casing to be inserted in the bore as the bit can not be removed while at the end of the blind hole. The well casing material is inserted though a cavity disposed inside of the drilling string remaining in the bore hole with the specially constructed drill bit and sonde housing remaining at the blind hole end of the bore hole. Typically, the inserted casing would block removal of the drill string with the drill bit fixed at its end. However, with the specially constructed knock off drill bit the casing may be inserted while the drill bit remains at the end of the bore 503.

Next to allow the drill string to be removed from the bore and leave the casing in place, the drill bit is remotely disconnected from the drill string and left at the blind end of the bore 504, allowing the drilling string to be removed.

The drilling string supports the casing and keeps the bore open as the drilling string is extracted 505. Once the drilling string is extracted, the casing walls are no longer shielded by the interior cavity of the drilling string, and the casing walls are then in close proximity or contact with the walls of the bore hole. Since the casing is already in place when the drilling string is removed, there are no problems with trying to insert a casing down a collapsed bore hole. As the walls of a bore hole collapsing can be a problem in the conventional process, especially in loose soil, accordingly this system allows for increased productivity in drilling single ended completion wells, as the need for re-drilling collapsed bore holes, or even being unable to drill a bore hole in loose soil tends to be eliminated.

In exemplary operation, the driller assembles a drill head assembly 1000 including, at the far end, the knock off bit assembly 1003, coupled either directly or with an adapter 1002, 1005 to the offset transmitter sonde assembly 800. In turn, the offset transmitter sonde assembly is connected, directly or by use of an adapter, to the end of a flush interior drill rod 1007. As the borehole is advanced 501, with steering and navigation, additional drill rods (not shown) are added to the advancing drill string 507.

The drilling process continues as previously described, until the bore reaches the desired depth 502. In the current example the permanent well materials 508 that are to be left in the bore may include well screen (not shown) and well casing materials that are to be installed in the completed bore are assembled and inserted into the inside annulus of the drill rods 1007. When the permanent well materials reach the end of the drill string, they are physically manipulated by a combination of pressure and/or rotation in order to unlatch the knockoff bit assembly 1003 and may push the knock off assembly 1003 away from the end of the drill string. In this fashion the permanent well materials 508 are then enabled to exit the end of the drill string and enter the open bore. The drill rods 1007 are then extracted from the bore, leaving the permanent well materials 508 in place.

A method of creating a well described herein may utilize one or more unique components or sub assemblies 1003, 1002, 1005, 800, 1007 which may be combined into a system, as described above, and operated in accordance with a method to produce a well.

Figure 6:
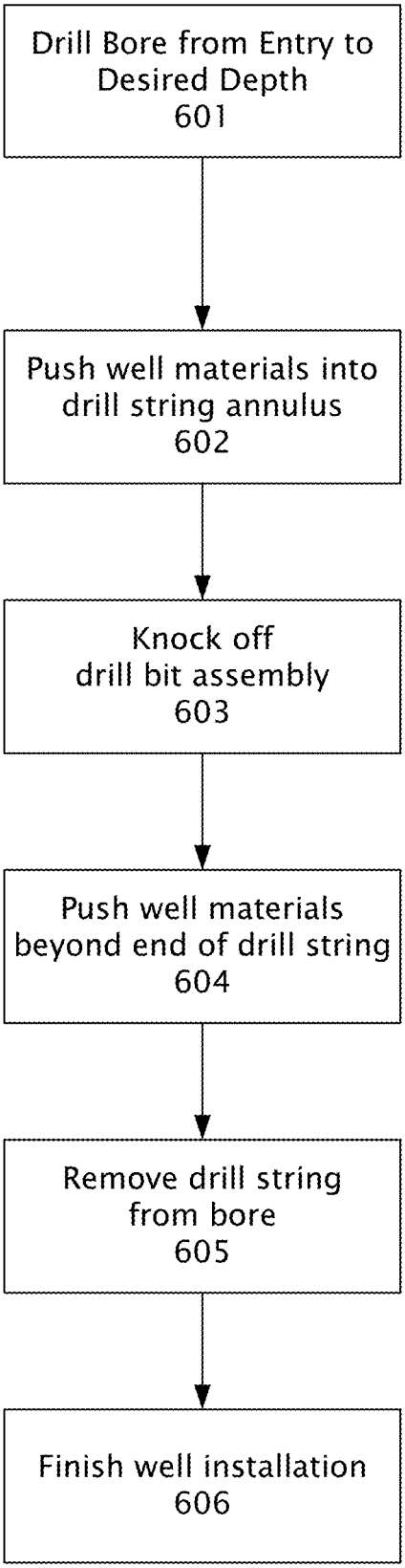
FIG. 6 is a process flow diagram showing a unique, exemplary method of creating a well utilizing the system described herein.

FIG. 6 is a process flow diagram showing a unique exemplary method of creating a well utilizing the system described in FIG. 5. First at block 601 a bore is drilled from an entry point to a desired depth with the specially constructed drilling string. At block 602 the drilling crew, with the aid of the drilling rig push or otherwise insert, or install the well casing materials through an annulus disposed in the drilling string. The casing materials are disposed in the interior of the drilling string. As the well casing materials reach the end of the bore, they encounter a latch mechanism disposed on the knock off drill bit assembly that when actuated by engagement with the well casing materials causes the drill bit assembly to disengage or otherwise uncouple from the drilling string at block 603. At block 604 the well casing materials may be used to further push the disengaged drill bit assembly, and the well materials past the end of the bore. This may be done to position an exemplary well screen, or otherwise free the end of the bore from obstruction.

At block 605 the drilling string is removed from the bore leaving the well casing in contact with the surrounding ground, and the sacrificial knock off drill bit assembly in the ground at the end of the bore hole. At block 606 well installation is completed.

In the system and method previously described, a specially constructed offset transmitter sonde assembly that contains an open central passage through which well casing can be inserted, and a specially constructed drill bit assembly that can be remotely activated to open a passage, whereby the casing can be installed in a directional drilled bore. In particular the method described above may utilize 1) an offset transmitter sonde assembly, 2), a knock off drill bit assembly and 3) a flush interior drilling string which will be described in the following paragraphs.

Figure 7:
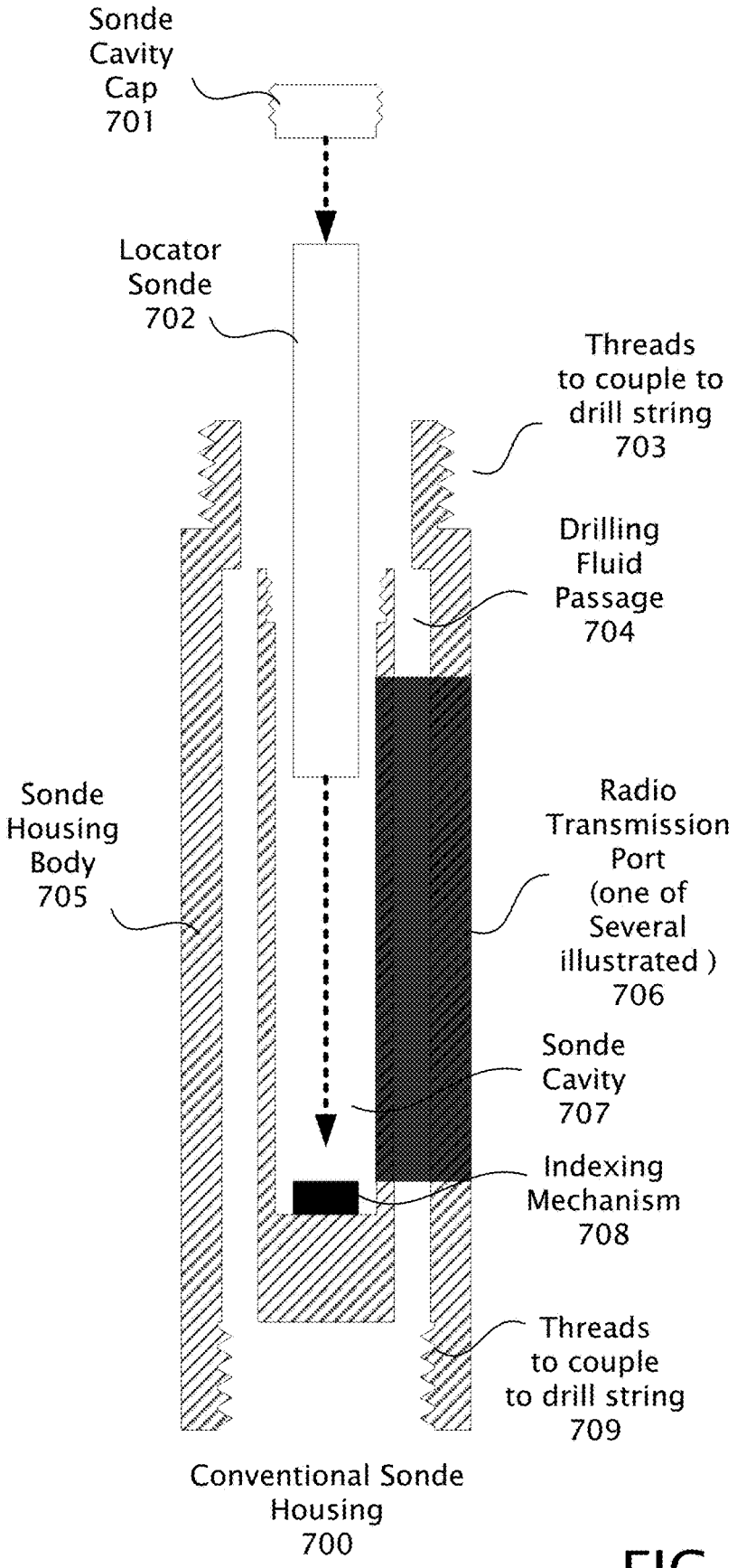
FIG. 7 shows a conventional centered sonde assembly.

FIG. 7 shows a conventional centered sonde assembly 700. In this device a sonde 702 is coaxially located in a sonde cavity 707 that may include an indexing mechanism 708. The cavity 707 may be sealed with a cap 701 to protect it from drilling fluid flowing through passageways 704, and from other contaminants.

Location and guidance of the drilling is important since the drill bit is not visible while drilling. If uncontrolled or unguided the well path can deviate from the desired path.

Various types of locating equipment may be used for locating the droll bit. A sonde, or transmitter, typically disposed behind the drill bit may register angle, rotation, direction, and temperature data. This information may be encoded into an electro-magnetic signal and transmitted through the ground to the surface so that a nearby receiver may pick up the signal. The signal is decoded and steering directions may be relayed to the drilling machine operator to change the course of the drilling The sonde is typically a radio frequency device, and for the radio waves to be received ports 706 are typically provided in the sonde housing 705. The sonde housing 700 may be coupled in line with the drilling string and accordingly threads 703, 709 may be provided to couple the sonde to the drilling string.

In this type of unit the locator sonde 702 is located in the axial center of the drilling string. This type of sonde is unsuitable for use with the present examples since the center location of the sonde 702, when thread coupled to the drill string 709, would prevent insertion of the well casing, and also interfere with the ability to use the well casing to knock off the drill bit assembly.

Figure 8:
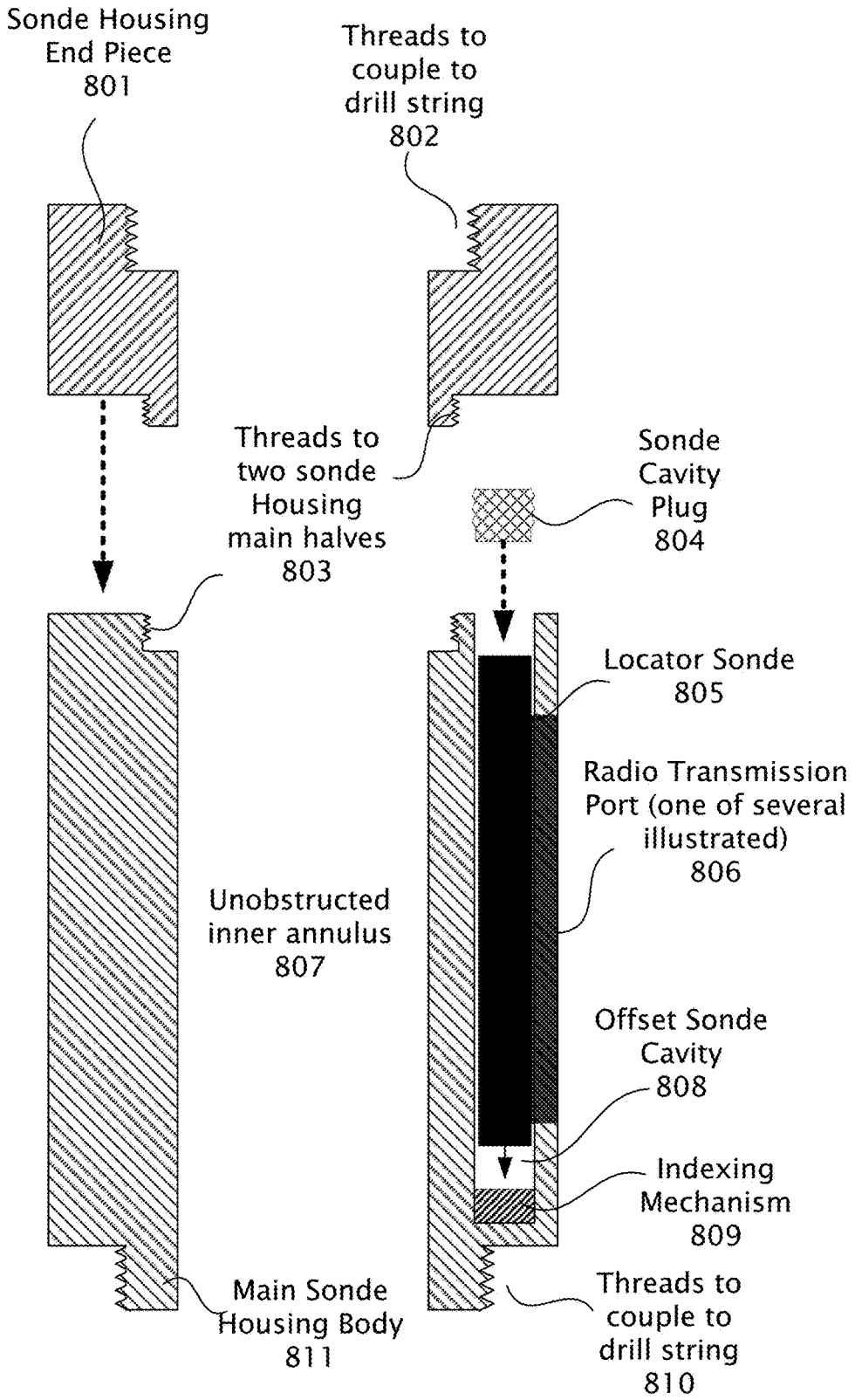
FIG. 8 shows a specially constructed offset transmitter sonde assembly.

FIG. 8 shows a specially constructed offset transmitter sonde assembly 800 suitable for use in the exemplary system. The example described herein is of a special "offset" sonde which differs from a conventional sonde housing previously described. In the current configuration, the cavity 808 which holds the locator sonde 805 is disposed within the sonde housing 811 in its exterior wall, and not at the center. Advantageously the sonde 805 is in close proximity to one or more radio transmission ports 806. The cavity is plugged 804, and an indexing mechanism 809 may be disposed in the cavity 808. This arrangement clears the center of the housing 807 so that the well casing is not blocked. The centralized sonde of FIG. 7 tends to block the advancement of tooling through the central annulus of any drill rods that are attached to it.

Various configurations of ports may be machined into the housing to permit the free flow of drilling fluid past the offset sonde 804, 806, 808, 809, through various adapters or couplers, through the drill bit assembly, and finally exit from the cutting face of the drill bit. The exemplary sonde housing may utilize a two piece housing including a sonde housing end piece 801 that may be thread coupled, or equivalently coupled 802 to a drill string. The opposite end of the end piece may include threads or their equivalent to couple to the main housing 811.

The offset transmitter sonde assembly may include a housing 811 which contains an internal passage 807 through which well casing (not shown) can be inserted, a cavity 808 in which a transmitting sonde 806 can be disposed, threaded ends 802, 810 by which the assembly can be attached to a drill string, and various passages and ports through which conventional drilling fluid, such as an aqueous based bentonite, polymer drilling fluid (not shown) or the like can be circulated and from which electromagnetic signals can be broadcast from a commercially-available transmitting sonde 805 to the exterior of the assembly 806. The sonde assembly may be constructed from any suitable material.

The sonde is located to allow the viscous aqueous fluid known as drilling mud to circulate to the drill bit. Allowance in the design is made to pump the drilling mud to the cutting head or drill bit so that it may remove cuttings, and cool the drill bit and the electronics in the sonde among other functions.

Figure 9:
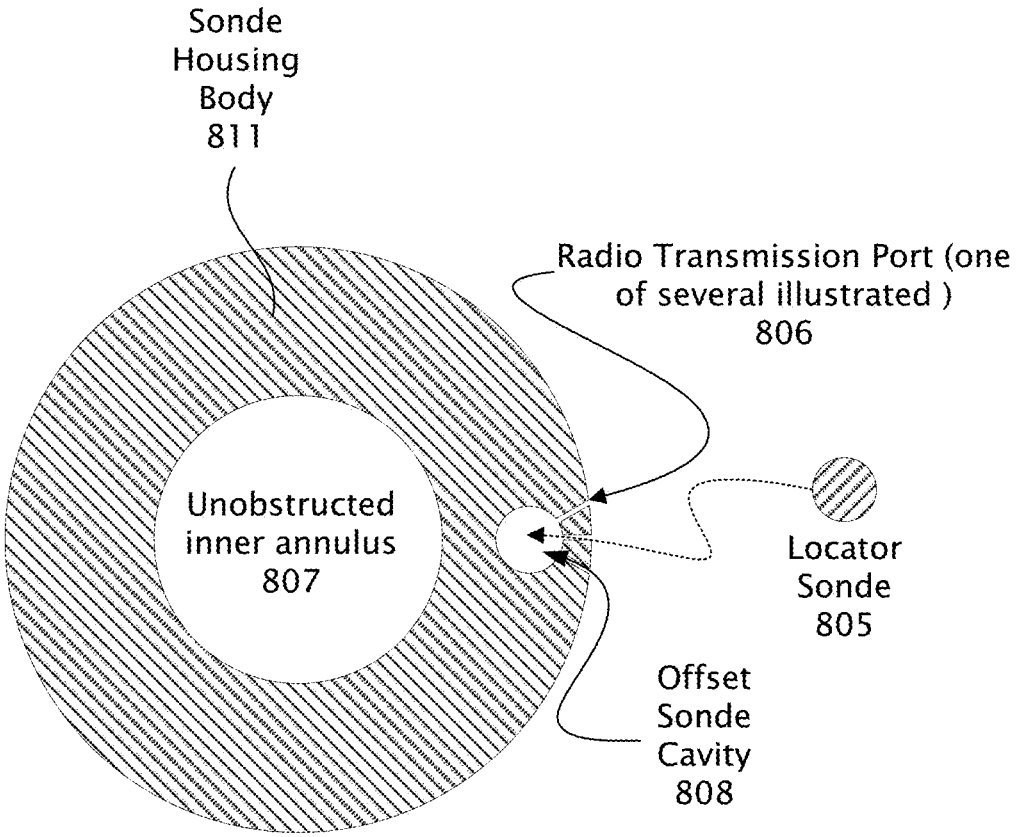
FIG. 9 shows an end view of the offset sonde housing.

FIG. 9 shows a simplified end view of the offset sonde housing 811. The offset transmitter sonde assembly 800 described enables the operator to use a commercially available locating sonde 805, disposed in an offset sonde cavity 808, and transmitting through radio transmission ports 806, with the knock off bit assembly. The offset sonde assembly 800 may be constructed such that the sonde 805 is located off the longitudinal axis of the drill string and does not block the central annulus thereof, which remains unobstructed 807. Well casing materials (not shown) can be inserted through the central annulus 807 without being obstructed by the sonde 805, which would be the case with a conventional, centered sonde housing.

Figure 10:
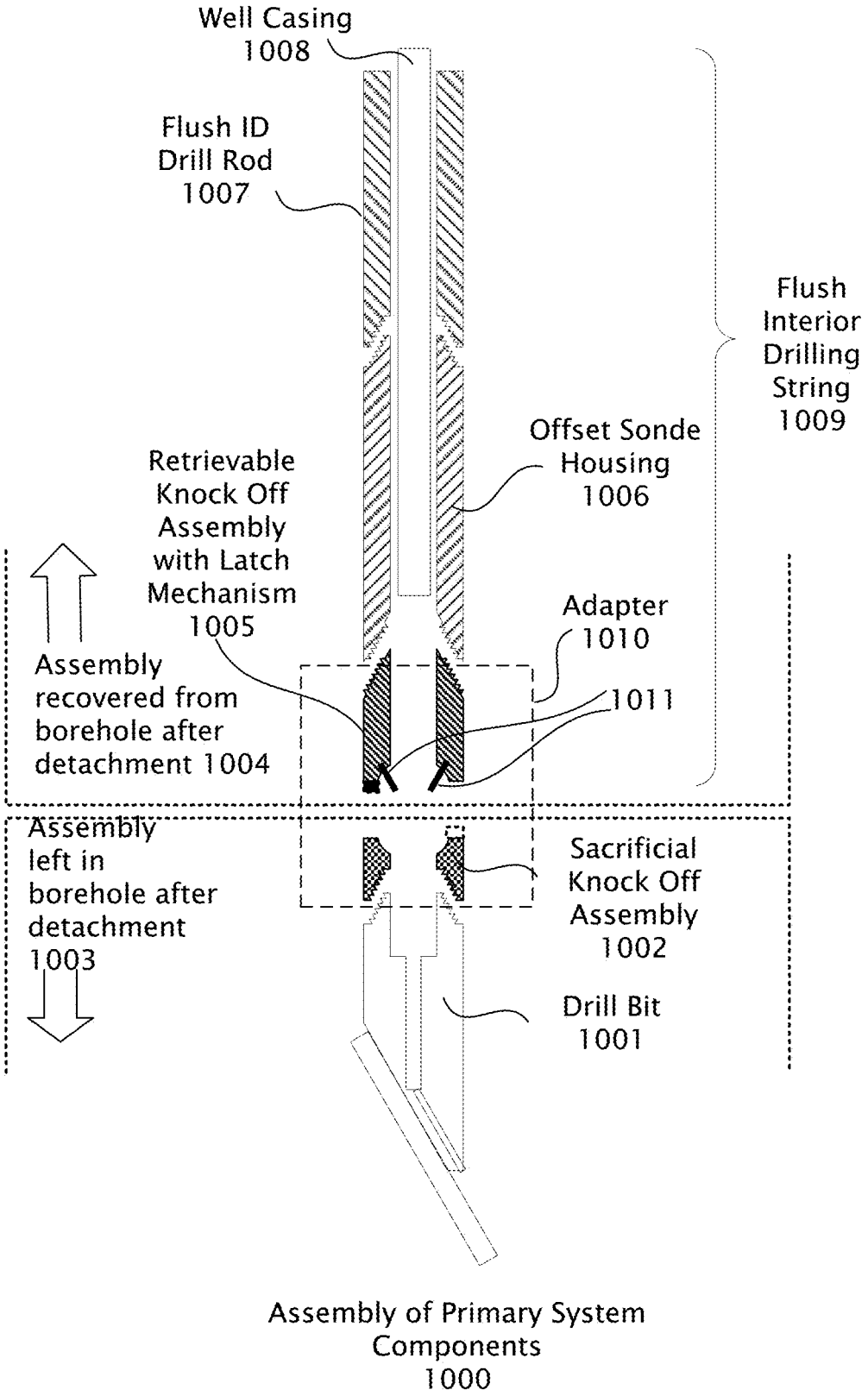
FIG. 10 shows the assembly of drill string systems components, including the adapter with latch mechanism coupling a sacrificial drill bit assembly to an offset sonde housing forming a flush interior drilling string.

FIG. 10 shows the assembly of drill string components 1000 including a offset sonde knock off drill bit assembly 1002 coupled to a flush interior drilling string 1009. The primary system components 1000, may be considered to form two major subassemblies; the assembly recovered from the bore hole after detachment, 1004, and the assembly left in the bore hole after detachment 1003. During use the detachable assembly is firmly coupled to the drill string unless actions are taken to specifically detach it. In operation an operator can trip in and out of the bore hole in the usual way to change bits, etc. without doing anything different then usual in drilling. The detachable assembly is only knocked off when a decision is made to do so and the proper tooling is inserted that will knock off the drill bit.

The assembly recovered from the bore hole after detachment 1004 may include a flush interior drilling string 1009, includes a retrievable portion, or equivalently the retrievable knock off assembly with latch mechanism 1005 of an adapter 1010 coupled to the transmitter sonde assembly 1006 then to a plurality of individual drill rods 1007 coupled end-to-end in a continuous string going back to a drill rig (not shown). Each drill rod 1007, and the offset sonde housing contains an interior annulus, which is flush through the entirety of the string with no protrusions into the annulus. The annulus is of sufficient diameter to allow a selected well screen and casing 1008 to pass through. The adapter portion withdrawn 1005, may include a latch mechanism that is recovered.

The assembly left in the bore hole after detachment 1003 includes a sacrificial adapter, or sacrificial knock off assembly 1002, which is part of the adapter 1010 that remains in the bore hole. The sacrificial adapter 1002 couples to a detachable drill bit 1001. The sacrificial adapter may include a standard female threaded portion, into which a standard drill bit 1001 can be coupled.

The latch mechanism 1011 may be constructed in any suitable way to allow the sacrificial knock off assembly described herein to be knocked off utilizing the method of actuating knocking off the bit described herein. In the example provided herein, the retrievable knock off assembly with latch mechanism 1005 attaches to the sacrificial knock off assembly 1002 with a cam or latch arrangement 1011 which can be unlatched when desired to insert well casing. Unlatching the cam mechanism 1011 detaches the bit holder or sacrificial knock off assembly 1002 and bit 1001 from the drill string 1005, 1006, 1007, leaving it 1002, 1001 in the borehole. Unlatching is achieved by the action of inserting the well casing (and typically including a well screen) 1008 through the hollow drill rod 1007, so that when the casing 1008 reaches the latch mechanism 1011, contact with the latch mechanism 1011, disengages the latch 1011.

The construction of the latch may be provided in various alternative examples in which configurations of parts which lock in place to retain the drill bit sacrificial knock off assembly 1002, and subsequently unlock with an unlatching collar or equivalent structure to release the latch 1011, are all within the scope of this invention. For example although a latching mechanism actuated by a pushing motion has been described, in alternative examples a latching mechanism that may be caused to unlatch by rotational movement, a combination of both, or any other motion or force that may be applied to the adapter 110 may be provided. Further, the sacrificial knock off assembly 1002 may also be used to retain an end plug or other tooling, which is subsequently uncoupled to permit casing installation in a pre-drilled bore.

The adapter 1010 may be constructed to retain a standard horizontal directional drill bit or tri-cone bit 1001 while drilling, and enables the bit 1001 to be remotely detached from the assembly recovered 1004 from the bore hole when the borehole has been advanced to a target location. The assembly contains a retrievable knock off body 1005 and a sacrificial knock off body 1002, which are coupled through a torque-transmitting coupler such as a Hirth coupler or other splined coupling. The drill bit 1001 may be threaded into the sacrificial body 1002, which is then locked into the retrievable body 1005 and may be held in place with set of splines and a latch mechanism, or its equivalent. The latch mechanism 1011 prevents the sacrificial body from becoming unlatched in normal use. The adapter 1010 can be constructed to fit virtually any drill bit diameter or thread size, or may be assembled to a standard bent sub and used with a conventional tri-cone drill bit. The assembly may be constructed of a variety of materials, including carbon steel, stainless steel, or non-magnetic alloy.

The latch may be constructed as needed to implement the disengagement process provided below.

Figure 11:
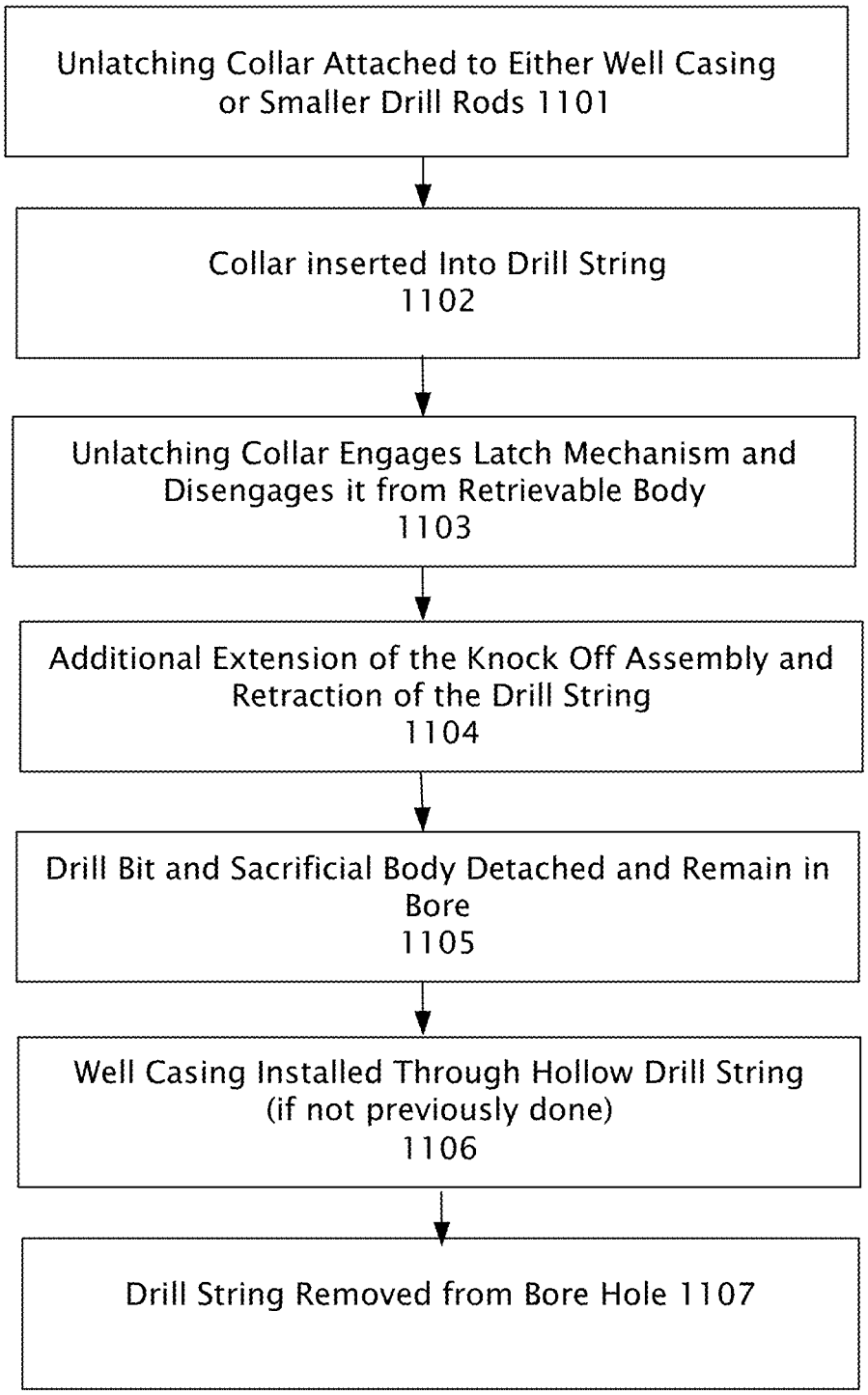
FIG. 11 is a process flow diagram for a process of detaching or knocking off a drill bit.

FIG. 11 is a process flow diagram for a process of detaching or knocking off a drill bit. The adapter is constructed to facilitate the disengagement of the drill bit remotely either by engagement with the well casing, an unlatching collar, or other such tool. For example, when it is desired to remove the drill bit from the end of the drill string, at block 1101 an unlatching collar is attached either to the end of the well casing or to a set of smaller drill rods, 1102 extended inside the drill string to put the unlatching collar in close proximity to the adapter for unlatching. The knock off tool may be inserted into the drill string at the distal end of well casing to be installed in the bore, or may be attached to a smaller diameter drill string to detach the drill bit retainer and bit prior to well casing placement. At block 1103 the unlatching collar engages the latch mechanism and unlocks it from the retrievable body. The knock off tool may be operated by a linear extension of the tool ("pushing") along the axis of the knock off bit assembly, or the retainers may be configured to require a rotational movement to unlock. In the current description, a straight linear motion is described. With additional extension of the knock off assembly and retraction of the primary drill string at block 1104, at block 1105 the drill bit and sacrificial body are detached from the end of the drill string and left in the bore as the well casing is installed (if not previously done at block 1101) at block 1106 through the hollow drill string and offset transmitter sonde assembly. Finally the drill string is removed at block 1107.

To implement this process the knock off bit assembly can be assembled in a wide variety of configurations, and with different retention components. Including the examples provided herein, the present invention includes any configuration of parts which, when assembled, enables the drill bit to be remotely removed from the end of the drill string, leaving an open bore through the base housing, through which the well casing can be installed.

The following figures will further describe the knock off mechanism and process without the offset sonde assembly present. Although in equivalent alternative examples the offset sonde assembly may be included, or excluded from the drilling string depending upon the drilling situation, and operator preferences.

Figure 12:
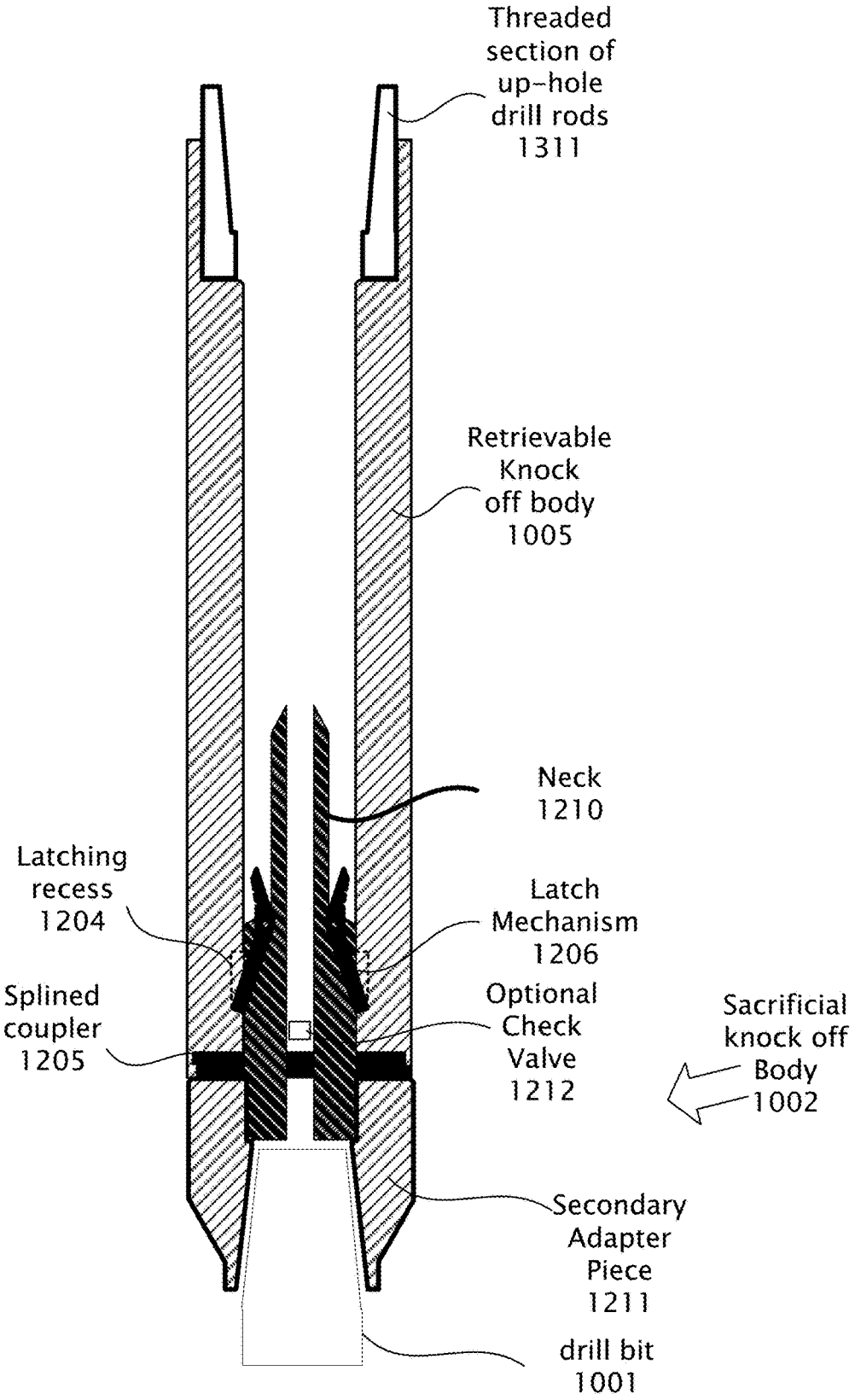
FIG. 12 shows the knock off bit assembly in the drilling configuration.

FIG. 12 shows the knock off bit assembly in the drilling configuration 1200. A drill bit assembly is provided including a novel coupling system that enables a soil or rock drilling bit and a portion of the drill bit assembly to be remotely disconnected from a drill string at a desired subsurface location. The assembly comprises a retrievable knock off body 1005 and a sacrificial knock off body 1002 to retain a bit 1001. Additionally, the adapter 1005, 1002 includes a latch mechanism 1206 that unlocks the sacrificial knock off body 1002 from the retrievable knock off body 1005, enabling the sacrificial knock off body 1002 with the drill bit 1001 coupled to it to fall free from the retrievable knock off body 1005.

The retrievable knock off body 1005 is a cylindrical tube of steel or other suitable material, with an inner diameter somewhat larger than the outside diameter of a well casing or a smaller diameter drill rod (not shown) that may be ultimately installed in the bore. At casing end of the retrievable knock off body 1005 a set of threads 1311 may be machined, and used to connect the retrievable knock off body 1005 to the end of the drill string 1311, which subsequently extends up hole to the drill rig. At the other end of the retrievable knock off body 1005 a splined coupler 1205 or its equivalent is formed in the removable knock off body 1005 and the sacrificial knock off body 1002, and include a set of radial serrations. Alternatively, the splines do not have to be radial. The splines could be aligned with the long axis as well, as long as the interior passageway inside the female splines is large enough to allow well casing to pass through. Mating engage to mating serrations to rotabaly drive the drill bit 1001. These mating serrations or teeth comprise a Hirth coupling which transfers torque from the retrievable knock off body 1005 to the sacrificial knock off body 1002, and drill bit 1001 during drilling. Previously drillers have placed crude caps on the ends of casing or drill rods. However such a crude arrangement is not able to transfer torque which enables enable a cutting drill bit to be used to create the bore. Inside the retrievable knock off body 1005 is a plurality of latching recesses 1204, which engage a matching set of pivotally disposed locking levers in a latching mechanism 1206 on the sacrificial knock off body 1002, to lock the Hirth, or splined coupling 1205 together during drilling operations. The serrations of the Hirth coupling which engage with the mating serrations of the retrievable knock off body 1005 are machined into the secondary adapter piece 1211.

The sacrificial knock off body 1002 may be a cylindrical tube of steel or other suitable material having a secondary adapter piece 1211 and a neck 1210 extending into the annulus of the retrievable knock off body 1005. The neck 1210, may form a guide for an unlatching collar (1303 of FIG. 13) that may slidebally engage the neck to activate the latch mechanism 1206. Into the neck 1210 may be formed the latch mechanism 1206, may be pivotally disposed, and with levers coupled to latching recesses 1204 to keep the coupler 1205 engaged. It may be coupled by any suitable method to a secondary adapter piece 1211 which may include a portion of the coupler 1205, and also couples to the drill bit 1001. To couple the sacrificial knock off body 1002 to the drill bit 1001 it is threaded with industry-standard female threads. The threads engage with mating threads on a standard drill bit 1001. Alternatively, the neck 1210, and the second adapter piece 1211 may be machined or otherwise formed from a common piece of material, eliminating any need to couple two separate pieces.

The latching mechanism 1206 includes a plurality of locking levers, in which springs, and axles or pins may hold the levers in an engaged position to the recess 1204. Alternatively, the latching mechanism 1206 may be constructed to couple to the sacrificial knock off body 1002 to the retrievable knock off body 1005.

In alternative examples a conventionally constructed check valve 1212 may be disposed within the knock off portion 1002 of the device. The check valve can help ensure that the latch mechanism will unlatch properly to release the knock off. If the check valve 1212 is not included, sand or silt can back flow up inside the bit and plug up the latch 1206, preventing the bit 1001 from being released.

The coupler body 1005 is coupled through a threaded coupling 1311 to a drill string, comprising a plurality of connected drill rods that extend to the drill rig. As the boring is advanced, additional drill rods are attached to the drill string at the drill rig. The coupler body threaded coupling 1311 may be machined with any of several standard thread patterns. The coupling between the coupler body 1301 and the drill string may be made directly to a drill rod end, or to an adapter or sub, which may be used to adjust the length of the drill string or to adapt from one thread pattern to another. The coupler body connection may also be made to an offset sonde housing (800 of FIG. 8), which contains an electronic package that is used for locating the drill bit while drilling in order to enable steering corrections to be made.

The borehole is advanced using conventional horizontal directional drilling technology, with walkover navigation. The electronics sonde for the walkover navigation are enclosed in the offset sonde housing (not shown).

Figure 13:
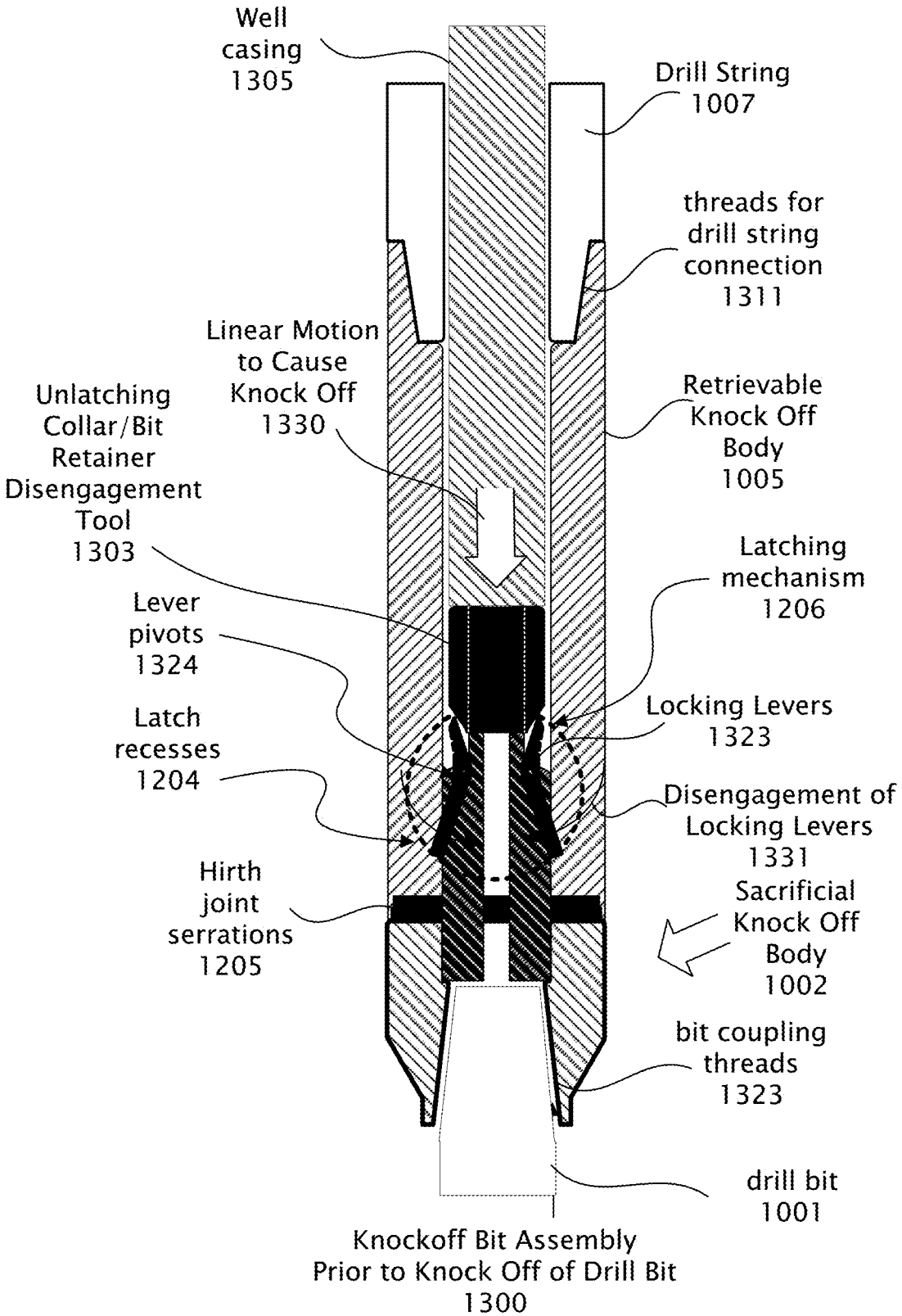
FIG. 13 shows the knock odd drill bit assembly prior to being detached, or knocked off.

FIG. 13 shows the knock odd drill bit assembly prior to being detached, or knocked off 1300. In this view a bore hole has been completed and the exemplary well casing, or smaller diameter drill rod 1305 has been inserted through the drill string 1007. At the end of the drill string may be disposed any suitable structure to uncouple the drill bit 1001 such as the exemplary unlatching collar or bit retainer disengagement tool 1303.

In knocking off the drill bit linear motion 1330 transmitted through the well casing by an operator, causes the unlatching collar 1303 to engage the neck of sacrificial knock off body 1002 where the collar 1303 is guided outwardly engaging the ends of locking levers 1323 through force exerted by the collar 1303. Locking levers 1323, are generally linearly formed structures, and are pivotally coupled to sacrificial knock off body 1002. On the side of the pivot 1324 opposite to that being outwardly engaged by the unlatching collar, the lever extension is forced inwards 1331, to disengage the sacrificial knock off body 1002, since that end of the locking lever 1323, had previously been engagedly coupled to a recess 1204 disposed in the retrievable knock off body 1002. The discussion above has focused on describing the operation of a single latch however it is understood that a plurality of latching mechanisms may be present, and operable at the same time.

Figure 14:
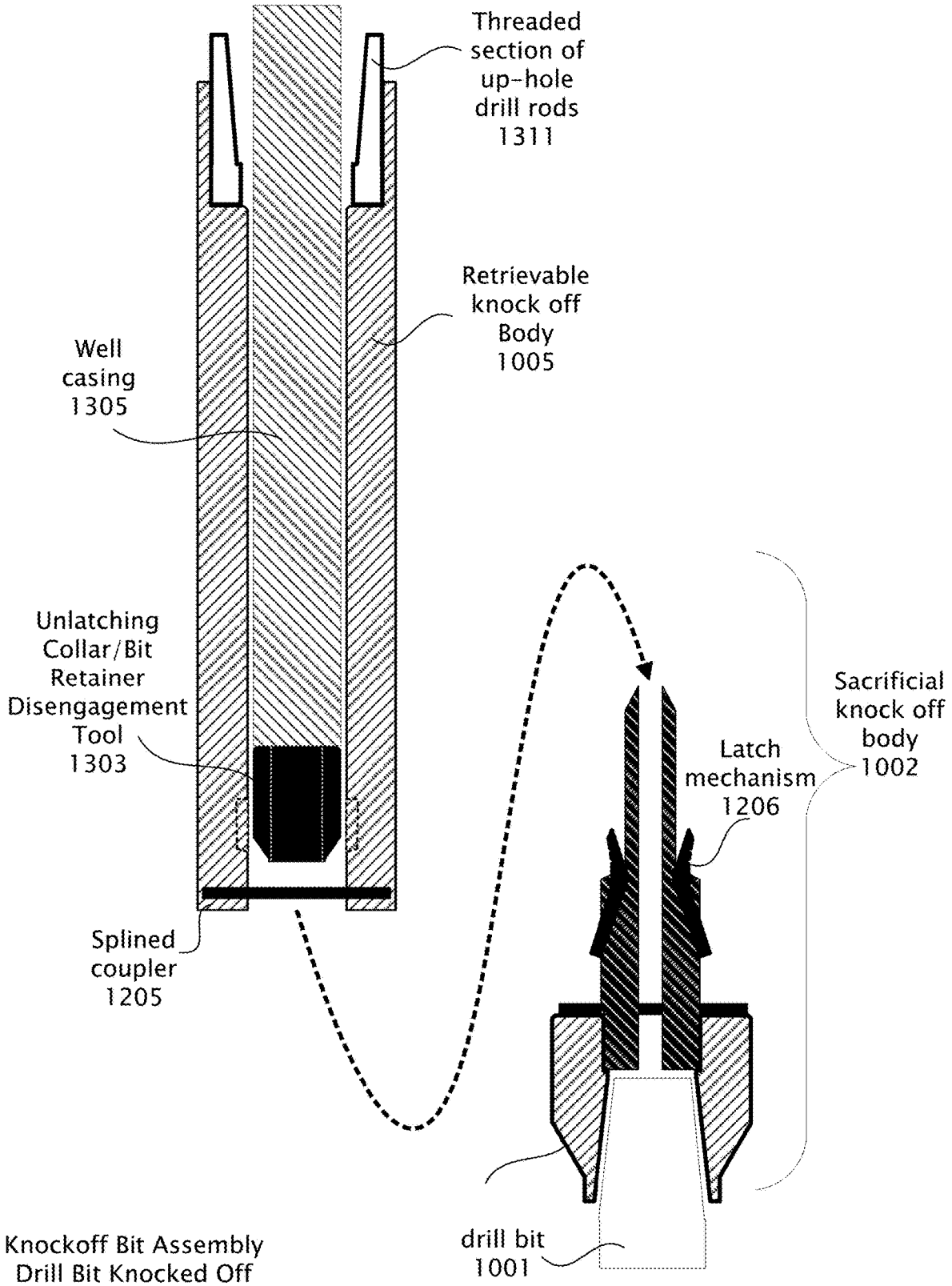
FIG. 14 shows the knock off bit assembly knocked off or detached from the drilling string.

FIG. 14 shows the knock off bit assembly knocked off or detached from the drilling string 1400. The well casing 1305, with the unlatching collar 1303 disposed at its end, has disengaged the sacrificial knock off body 1002, by uncoupling latch mechanism 1206, through it's being pushed through the interior of the well casing 1305. Once detached the well case, may be pushed further so that the end of the bore is somewhat cleared. The well casing 1305 may be retracted as needed to distance it from the sacrificial knock off body 1002 remaining in the bore hole. Finally the hollow drill rod covering the well casing may be removed, leaving the well casing disposed in the well bore.

In the description herein horizontal is generally taken to mean generally having more run than rise (45 degrees or less elevation from I level plane). However, horizontal as used in describing the boring angle capable of being created by a horizontal drilling machine, and may include bores of a constant bore angle, or bores that change their angle, such as those that may be created by first drilling at an acute angle with the ground surface, and are then caused to level off to a substantially horizontal angle.

Those skilled in the art will realize that the process sequences described above may be equivalently performed in any order to achieve a desired result. Also, sub-processes may typically be omitted as desired without taking away from the overall functionality of the processes described above.

The invention claimed is:

1. A locking gun mount comprising:

a top frame having a rectangular spring housing disposed in a back surface of the top frame with a first rectangular tab formed in the top frame along an edge of the top frame and including a top back plate;

a bottom frame having a rectangular spring housing disposed in a back surface of the bottom frame with a second rectangular tab formed in the bottom frame along an edge of the bottom frame aligning with the first tab when the top frame and the bottom frame are in an assembled position, and having a lag mounting depression, shaped to accept a lag screw head including a bottom back plate having an aperture with a lag screw disposed therein, so that the lag screw is prevented from rotating with the lag screw inserted through the aperture and the lag screw head disposed in the lag mounting depression, whereby the bottom frame can be screwed into a mounting surface;

a shaft spring providing bias to separate the top frame from the bottom frame;

a shaft tube having at least a first side, a second side and a middle side disposed there between having a pair of bump stops disposed at opposite ends on an exterior of the shaft tube middle side, with the shaft spring disposed therein and extending past a first end of the shaft tube and a second end of the shaft tube, whereby the shaft tube is slidably disposed in the shaft housing and positioned so that the pair of bump stops are positioned to contact the first tab and the second tab to retain the top frame to the bottom frame in an open position of the locking gun mount;

a cam lock rotably coupled to the top frame, and axially attached to a circular pin, with a first ridge, and a second ridge disposed on a side of the circular pin to form a frame sprang, and the frame sprang slidably disposed in the bottom frame shaft housing and positioned so that the first ridge and the second ridge contact the first tab and the second tab when the cam lock is engaged to close the locking gun mount when the cam lock is rotated to a locked position with the bottom frame is pushed against bias of the shaft spring to contact top frame.

2. The locking gun mount of claim 1 in which the top backplate retains a first portion of the frame sprang to the top frame.

3. The locking gun mount of claim 1 in which the bottom backplate retains a second portion of the frame sprang to the bottom frame.

4. The locking gun mount of claim 1 further comprising a lag shield bearing disposed on the lag bolt.

5. The locking gun mount of claim 1 in which in the closed position the first rectangular tab and the second rectangular tab are held together by the first ridge and the second ridge.

6. The locking gun mount of claim 1 in which in the opened position the first rectangular tab and the second rectangular tab are pushed apart by bias from the shaft spring until stopped by the pair of bump stops contacting, each of which contacts the respective first rectangular tab, and the second rectangular tab..

7. The locking gun mount of claim 1 in which in the shaft tube is prevented from rotably turning by the interference of a flat side against a mating surface of the shaft housing.

8. The locking gun mount of claim 1 in which the top frame and the bottom frame are made from molly coated stainless steel.

9. The locking gun mount of claim 1 in which the top frame and the bottom frame are made from aluminum.

10. The locking gun mount of claim 1 in which the top frame and the bottom frame are made from nylon.

11. A locking gun mount comprising:

a frame sprang generally of elongate shape and including:
- an axial pin having a first pin end and a second pin end;
- a cam lock attached to the first pin end;
- a first projection on the axial pin; and
- a second projection on the axial pin positioned in line with the first axial pin so that a tab gap is formed between the first projection and the second projection;

a retaining device including:
- a shaft tube having at least three sides at right angles to each other and forming a channel having a channel length, and having a first shaft tube end and a second shaft tube end;
- a shaft spring having a spring length greater than the channel length, and slidabaly disposed in the shaft tube;
- a first bump stop attached to a side of the at least three sides of the shaft tube; and
- a second bump stop attached distally from the first bump stop to the side of the at least three sides of the shaft tube;
- a top frame with a planar top frame back surface and a top frame edge including;
- a top frame shaft and sprang housing forming a depression in the top frame back surface;
- a top frame tab formed in the top frame surface edge at a midpoint of the edge; and
- a top backplate coupled to the planar top frame back surface;

a botton frame with a planar bottom frame back surface and a bottom frame edge parallel to the top frame edge including:
- a bottom frame shaft and sprang housing forming a depression in the bottom frame back surface;
- a bottom frame tab formed in the bottom frame surface edge at a midpoint of the edge;
- a lag mounting hole formed in the bottom frame back surface; and
- a bottom backplate coupled to the planar bottom frame back surface.

12. The locking gun mount of claim 11 further comprising a fastener disposed in an aperture in the bottom backplate.

13. The locking gun mount of claim 11 where the tab gap is of a distance greater than the length of the top frame tab and the bottom frame tab.

14. The locking gun mount of claim 11 where the fastener is a lag screw.

15. The locking gun mount of claim 11 where the lag screw includes a lag shield bearing.

16. The locking gun mount of claim 11 in which the top frame and the bottom frame are made from molly coated stainless steel.

17. The locking gun mount of claim 11 in which the top frame and the bottom frame are made from aluminum.

18. The locking gun mount of claim 11 in which the top frame and the bottom frame are made from nylon.

19. A locking gun mount comprising:

a top frame means for retaining a firearm;

a bottom frame means for retaining a firearm;

a frame sprang means for holding the top jaw and the bottom jaw in a closed position; and an assembly means for holding the top jaw and the bottom jaw in an open position.

* * * * *